US007715772B2

(12) United States Patent
Ko

(10) Patent No.: US 7,715,772 B2
(45) Date of Patent: May 11, 2010

(54) IMAGE FORMING APPARATUS HAVING PRINT MEDIA-RELEASING MEMBER AND FUSING APPARATUS HAVING SAME

(75) Inventor: Young-soo Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 868 days.

(21) Appl. No.: 11/439,966

(22) Filed: May 25, 2006

(65) Prior Publication Data

US 2006/0291916 A1 Dec. 28, 2006

(30) Foreign Application Priority Data

Jun. 25, 2005 (KR) ..... 10-2005-0055362

(51) Int. Cl.
*G03G 15/20* (2006.01)

(52) U.S. Cl. ..... 399/323; 399/320

(58) Field of Classification Search ..... 399/320, 399/323

See application file for complete search history.

(56) References Cited

U.S. PATENT DOCUMENTS

| | | | | |
|---|---|---|---|---|
| 5,138,391 | A | 8/1992 | Takahashi et al. | |
| 6,658,229 | B2 * | 12/2003 | Ando et al. | 399/323 |
| 6,813,464 | B2 * | 11/2004 | Amita et al. | 399/323 |
| 2002/0025204 | A1 * | 2/2002 | Ando et al. | 399/381 |
| 2002/0098018 | A1 * | 7/2002 | Kamiya | 399/323 |
| 2003/0165348 | A1 * | 9/2003 | Amita et al. | 399/323 |
| 2005/0123330 | A1 * | 6/2005 | Yoshimura et al. | 399/328 |
| 2005/0276638 | A1 * | 12/2005 | Yamada | 399/323 |

FOREIGN PATENT DOCUMENTS

| | | |
|---|---|---|
| EP | 1 426 832 | 6/2004 |
| JP | 05119636 A * | 5/1993 |
| JP | 2001-324885 | 11/2001 |
| KR | 1998-66946 | 12/1998 |
| KR | 2000-20477 | 12/2000 |
| KR | 2001-58633 | 7/2001 |

OTHER PUBLICATIONS

English Abstract JP 05119636 A ,Author: Kitahara, Date: May 18, 1993.*

Office Action issued in Korean Patent Application No. 2005-55362 on May 25, 2006.

* cited by examiner

*Primary Examiner*—David M Gray
*Assistant Examiner*—Ryan D Walsh
(74) *Attorney, Agent, or Firm*—Staas & Halsey LLP

(57) ABSTRACT

An image forming apparatus having a print roller, in which a circumferential elastic contact part of the print roller contacts and presses a print medium to convey the print medium, the apparatus comprises a push roller pressing the print roller to elastically deform the circumferential elastic contact part; and a print media-releasing member including a claw member to be protruded into a space formed by the elastic deformation of the circumferential contact portion, the print medium being released from the print roller by means of the claw member.

44 Claims, 6 Drawing Sheets

IMAGE FORMING APPARATUS HAVING PRINT MEDIA-RELEASING MEMBER AND FUSING APPARATUS HAVING SAME

CROSS-REFERENCE TO RELATED APPLICATIONS

This application claims the benefit of Korean Patent Application No. 2005-55362, filed Jun. 25, 2005, in the Korean Intellectual Property Office, the disclosure of which is incorporated herein by reference.

BACKGROUND OF THE INVENTION

1. Field of the Invention

Aspects of the present invention relate to an image forming apparatus and a fuser therefor, and more particularly, to an image forming apparatus having a print media-releasing member for releasing a print medium from a heating roller, and a fuser for such an image forming apparatus.

2. Description of the Related Art

FIG. 1 is a sectional view showing a conventional image forming apparatus. As shown in FIG. 1, the image forming apparatus 100 includes a print media feeder 110 for feeding print media, an image forming unit 120 forming a toner image on the print medium conveyed from the print media feeder 110, and a print media ejector 130 discharging the print media conveyed from the image forming unit 120 to the outside.

Here, the image forming unit 120 includes a developer 121 having a photosensitive drum 122 for forming a toner image on a print medium 1, a transfer roller 123 rotating correspondingly to the photosensitive drum 122 with the print medium 1 placed in-between, and a fuser 124 for fusing toner onto the print medium 1 having the toner image formed thereon.

The fuser 124 is composed of a heating roller 125 heating the print medium 1 being conveyed from the developer 121 and a press roller 126 pressing the print medium 1 towards the heating roller 125. The toner formed on the print medium 1 is melted by the heating roller 125 and pressed by the press roller 126 therebelow to thereby be fused on the surface of the print medium 1. The print medium 2 fused with the toner is conveyed to the print media-ejector 130 and discharged to the outside.

In the above conventional technique, however, the toner on the print medium 1 is in contact with and pressed on the heating roller 125, so that the toner is likely to attach to the surface of the heating roller 125 during the fusing process. In this case, the print medium 1 sticks to the surface of the heating roller 125 by means of the toner and then rotates together with the heating roller 125. Thus, the print medium 1 itself may be creased and consequently jammed inside the image forming apparatus 100.

Moreover, in a case where the surface layer of the heating roller 125 is formed of a resilient material such as rubber, the print medium 1 attached to the heating roller 125 must be separated therefrom, without damaging the heating roller 125.

SUMMARY OF THE INVENTION

Aspects of the present invention provide an image forming apparatus and a fuser therefor comprising a print roller having a resilient surface layer, in which a print medium attached to the print roller can be easily released therefrom without damaging the print roller.

According to an aspect of the present invention, there is provided an image forming apparatus having a print roller, in which a circumferential elastic contact part of the print roller contacts and presses a print medium to convey the print medium, the apparatus comprising: one or more push rollers pressing the print roller to elastically deform the circumferential elastic contact part; and one or more print media-releasing members comprising a claw member to be protruded into a space formed by the elastic deformation of the circumferential contact portion, the print medium being released from the print roller by use of the claw member.

The push roller may, although not necessarily, be provided on both sides of the print media-releasing member.

A rotating axis of the push roller may, although not necessarily, pass through the print media-releasing member.

The print media-releasing member may, although not necessarily, be provided with a rotation shaft where the push roller rotates.

The push roller may, although not necessarily, be provided with a rotation shaft which is formed to pass through the print media-releasing member.

The print roller may, although not necessarily, further comprise a central part having a predetermined radius, and the circumferential elastic contact part comprises a surface layer formed of an elastic material, the surface layer being formed in the circumferential face of the central part and having a predetermined thickness.

The print roller may, although not necessarily, comprise an elastic body.

The print roller may, although not necessarily, be a heating roller.

According to another aspect of the present invention, there is provided a fuser for an image forming apparatus comprising a heating roller having a circumferential elastic contact part and a heater generating heat by an electric power externally supplied, and a press roller conveying a print medium interposed in-between with the heating roller while contact-pressing the print medium towards the heating roller, the fuser comprising: one or more push rollers pressing the heating roller to elastically deform the circumferential elastic contact portion; and one or more print media-releasing members comprising a claw member to be protruded into a space formed by the elastic deformation of the circumferential contact portion, the print medium being released from the heating roller by means of the claw member.

Two push rollers may, although not necessarily, be provided on both sides of the print media-releasing member.

A rotating axis of the push roller may, although not necessarily, pass through the print media-releasing member.

The print media-releasing member may, although not necessarily, be provided with a rotation shaft where the push roller rotates.

The push roller may, although not necessarily, be provided with a rotation shaft which is formed to pass through the print media-releasing member.

The heating roller may, although not necessarily, further comprise a central part having a predetermined radius, and the circumferential elastic contact part comprises a surface layer formed of an elastic material, the surface layer being formed in the circumferential face of the central part and having a predetermined thickness.

The heating roller may, although not necessarily, comprise an elastic body.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE EMBODIMENTS

Figure 1:
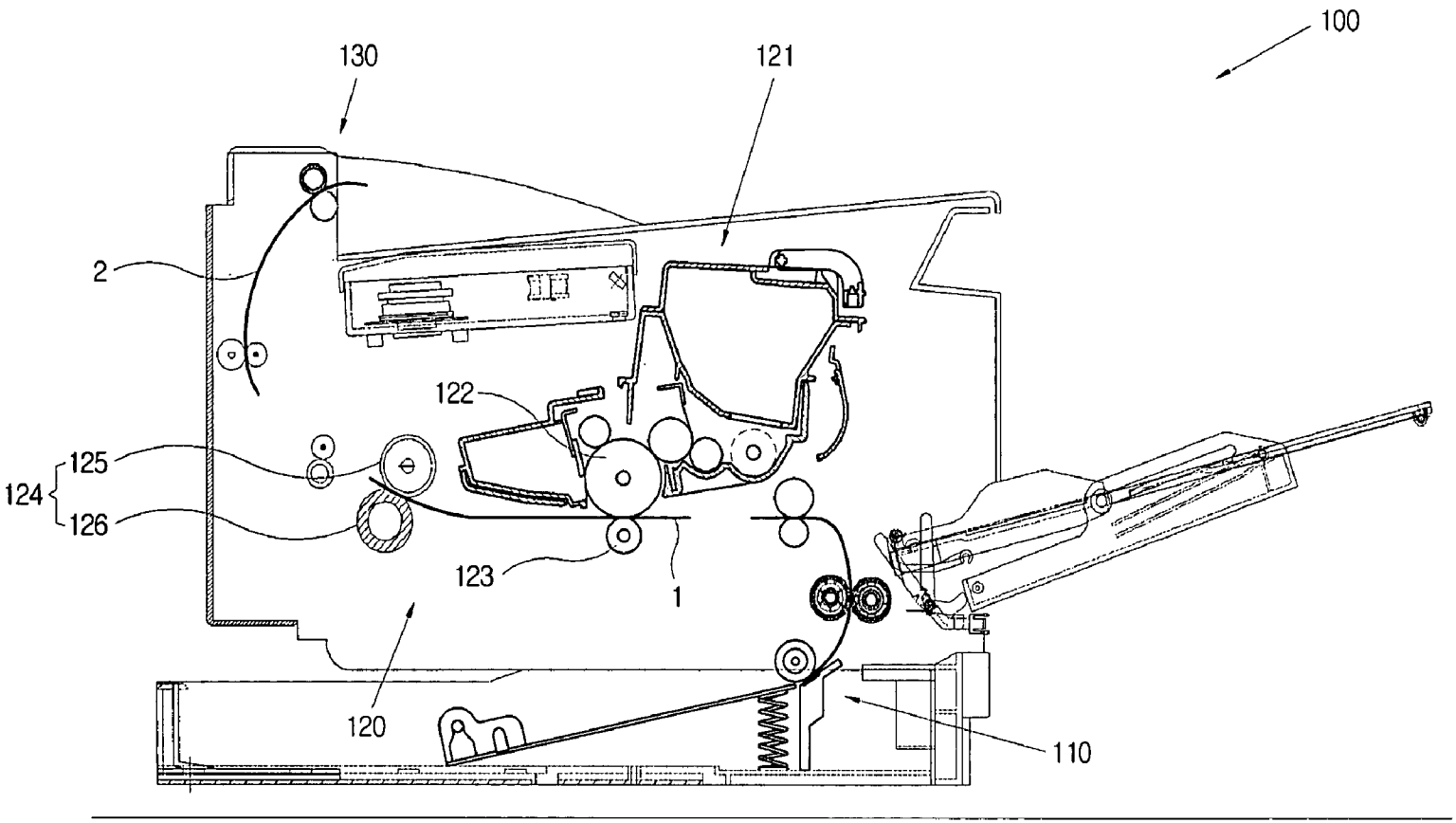
FIG. 1 (PRIOR ART)
FIG. 1 is a sectional view showing a conventional image forming apparatus.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
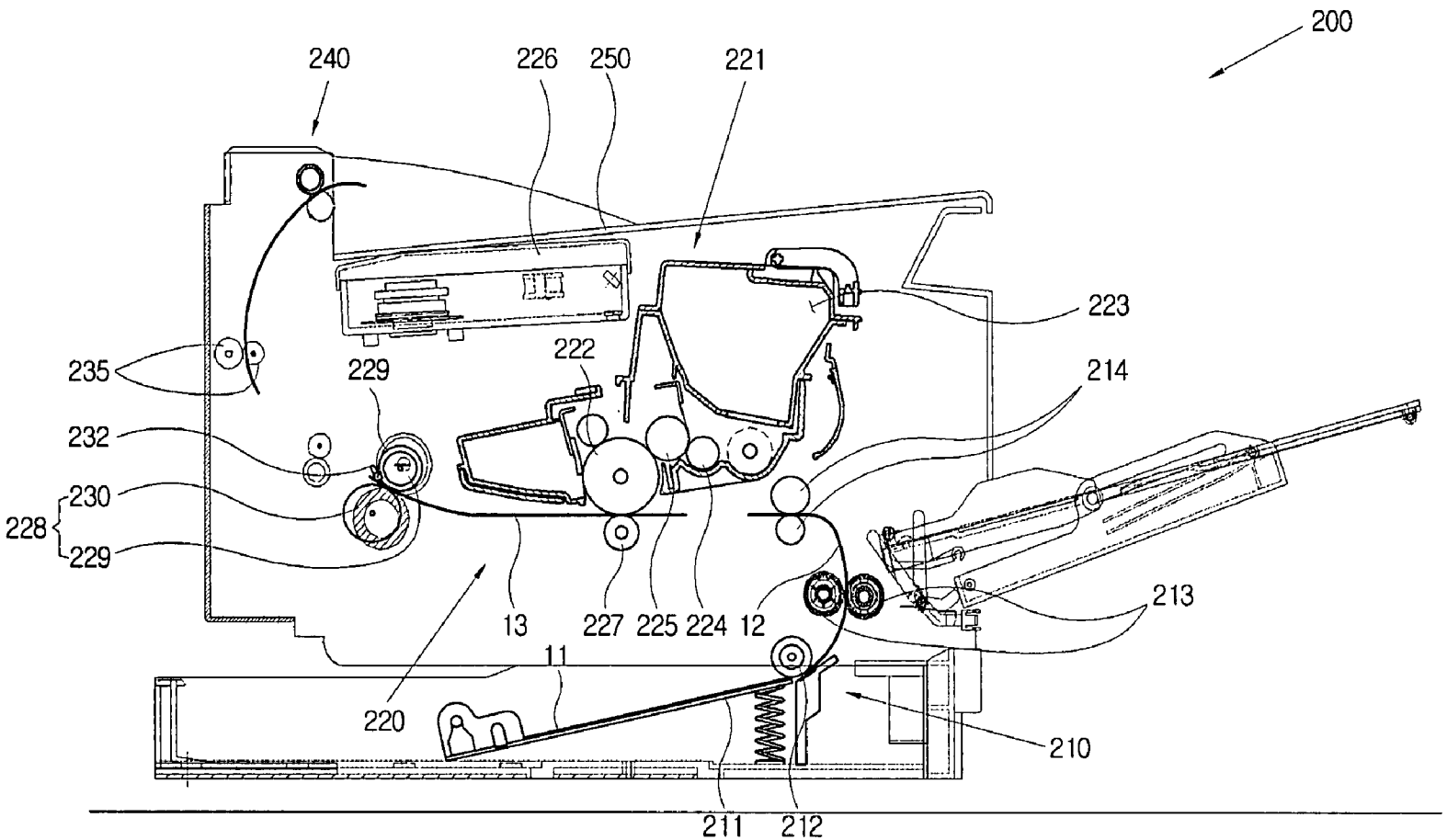
FIG. 2 is a sectional view of an image forming apparatus according to an embodiment of the invention.

FIG. 2 is a sectional view showing an image forming apparatus 200 according to an embodiment of the present invention.

As shown in FIG. 2, the image forming apparatus 200 comprises a print media feeder 210 for supplying print media 11, an image forming unit 220 forming a toner image on the print medium 13 conveyed from the print media feeder 210, and a print media ejector 240 for ejecting the print medium 13 conveyed from the image forming unit 220.

Other types of print media 13 aside from paper, such as transparencies, overheads, etc., may be used.

The image forming unit 220 includes a developer 221 having a photosensitive drum 222 for forming a toner image on a print medium 13, a scanning unit 226 forming a latent image on the photosensitive drum 222 of the developer 221, a transfer roller 227 rotating correspondingly to the photosensitive drum 222 with the print medium 13 placed in-between, and a fuser 228 for fusing the toner on the print medium 13 where the toner image is formed.

The print medium 11 loaded on a knock-up plate 211 of the print media feeder 210 is picked up by a pick-up roller 212 and supplied into a register roller 214 through a conveyor roller 213.

The register roller 214 conveys the print medium 12 to between the photosensitive drum 222 and the transfer roller 227, according to a print medium-advancing signal of a controller (not shown).

When the print medium 12 is conveyed, the scanning unit 226 generates a laser light corresponding to an image data, which is then radiated on the photosensitive drum 222. Thus, an electrostatic latent image is formed on the surface of the photosensitive drum 222.

In the developer 221, toner stored in a toner storage 223 is transferred to the electrostatic latent image via a supply roller 224 and a developing roller 225 to thereby form a toner image. The toner image formed on the surface of the photosensitive drum 222 is transferred onto the surface of the print medium 13 by means of electric force of a transfer roller 227. The print medium 13, on which a toner image is transferred, passes through the fuser 228 and at the same time the toner is fused on the surface of the print medium. Thereafter, the print media is stacked, through the print media ejector 240, on a print media stacker 250 provided on top of the image forming apparatus.

The fuser 228 comprises a heating roller 229 placed at the upper side thereof and a press roller 230 placed at the lower side thereof.

The heating roller 229 houses a heater (not shown), which generates heat through an electric power supplied from the main body of the image forming apparatus 200. The print medium 13 being conveyed from the developer 221 is heated up by the heater and thus the toner transferred on the surface of the print medium 13 is melted.

The press roller 230 presses the print medium 13 being heated by the heating roller 229 towards the heating roller 229. Thus, the toner on the print medium 13, heated by the heating roller 229, is fused on the surface of the print medium 13 by means of the press roller 230.

Figure 3:
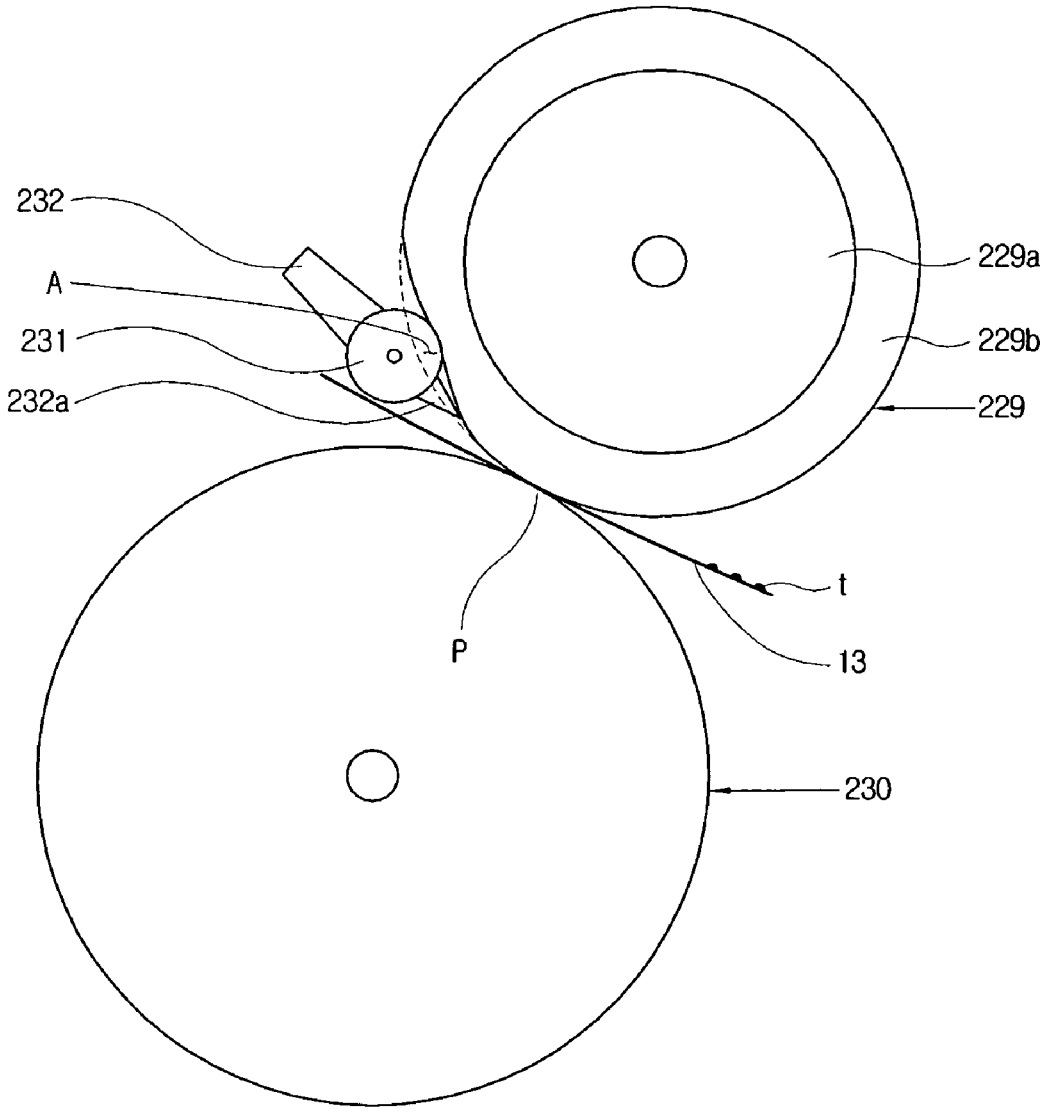
FIG. 3 is a magnified sectional view of a fuser in the image forming apparatus of FIG. 2.

FIG. 3 is an exploded sectional view of the fuser in the image forming apparatus of FIG. 2.

As shown in FIG. 3, the heating roller 229 includes a central part 229*a* having a predetermined radius, and a surface layer 229*b* formed along the circumference of the central part 229*a* so as to have a predetermined thickness. Here, the surface layer 229*b* is formed of a resilient material such as rubber, which can be easily elastically deformed, and provided as a circumferential elastic contact part.

In addition, a push roller 231 and a print media-releasing member 232 are provided in the print media-ejecting side of the heating roller 229. The push roller 231 contacts and presses against the heating roller 229, and has a rotation shaft, which passes through the print media-releasing member 232. Thus, as shown in FIG. 3, the surface layer 229*b* of the heating roller 229 is pressed by the push roller 231 and thus elastically deformed to form a space A.

The print media-releasing member 232 is wedge-shaped and has a claw member 232*a*, which is protruded inwards of the space A formed by the push roller 231.

Figure 4:
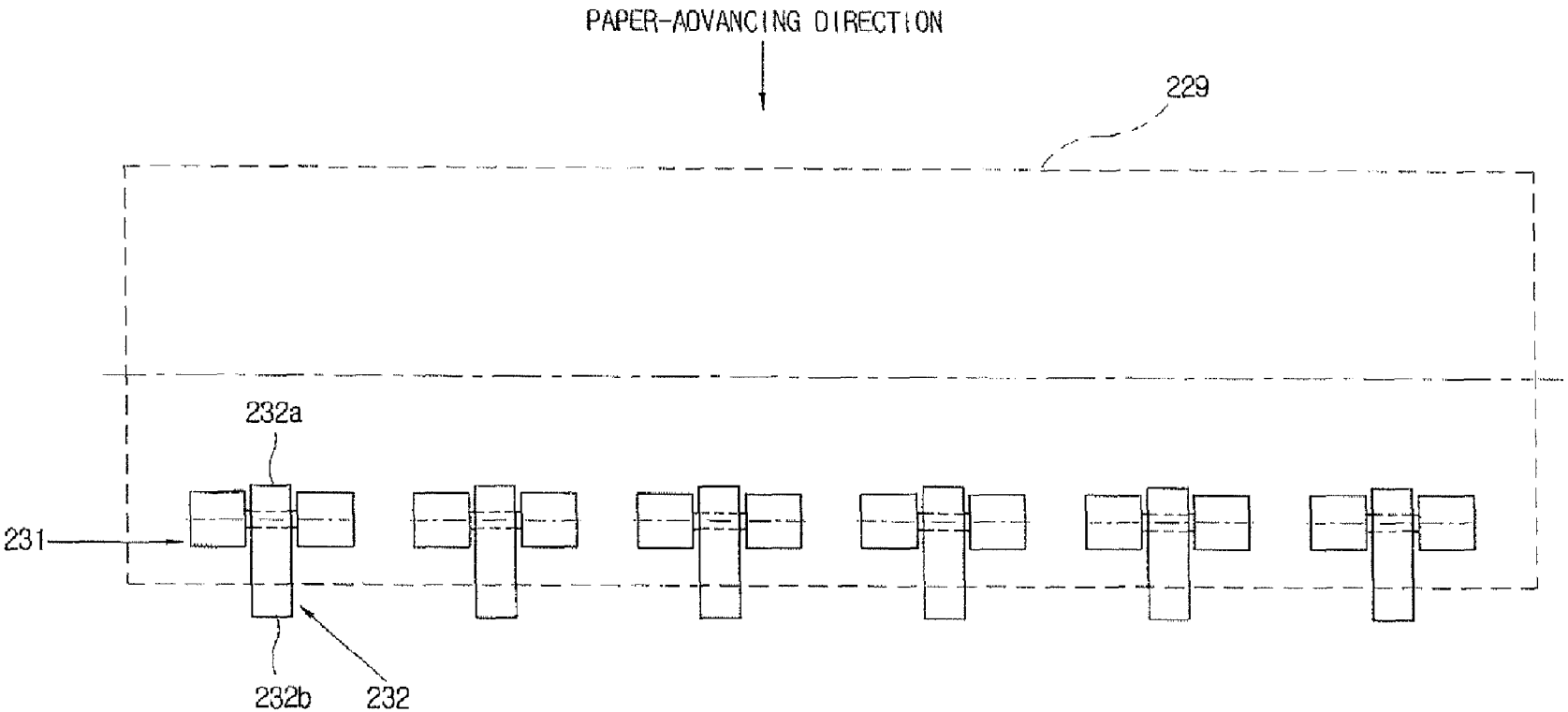
FIG. 4 is a plane view showing a push roller and a print media-releasing member in the fuser of FIG. 3.

FIGS. 3 and 4 show a combined structure of the push roller 231 and the print media-releasing member 232. As shown in the figures, the push roller 231 is disposed on both sides of the print media-releasing member 232 respectively and has a rotation shaft passing through the print media-releasing member 232 and connecting the two push rollers 231.

Here, the rotation shaft may be protruded from both sides of the print media-releasing member 232 and the push roller 231 may be provided with a shaft hole, so that the rotation shaft may be inserted into the shaft hole.

As shown in FIG. 4, one print media-releasing member 232 and two pusher rollers 231 constitute a group, and one or more groups of print media-releasing member 232 and push roller 231 may be provided, if necessary. FIG. 4 illustrates six groups.

On the other hand, body portions 232*b* of the respective print media-releasing members 232 may be inter-connected to form an integral body. In addition, the push roller 231 may have a smaller or larger diameter so as to form the space A having a desired size.

By the use of the above-structured push roller 231 and the print media-releasing member 232, the print medium 13 passing through the fuser 228 can be prevented from sticking to the heating roller 229.

Figure 5:
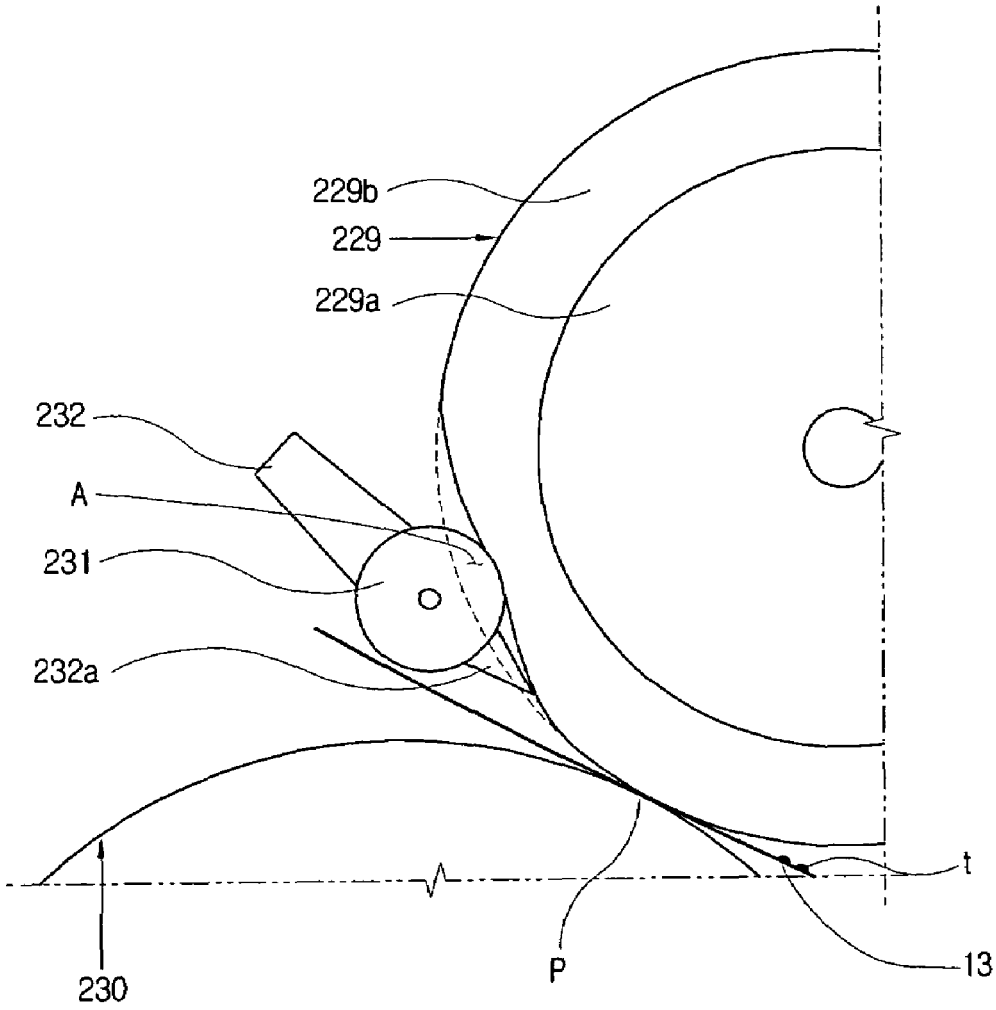
FIG. 5 is an exploded sectional view explaining the operational procedures of the fuser of FIG. 3.

FIG. 5 is an exploded sectional view explaining the operational procedures of the fuser of FIG. 3.

As shown in FIG. 5, toner t on the print medium 13 is fused on the surface of the print medium 13 while passing a contact point P (precisely, a contact plane) between the heating roller 229 and the press roller 230. At this time, the fusing toner t may cause the print medium 13 to stick to the heating roller 229. As shown in the figure, the surface layer 229*b* of the heating roller 229 is pressed and depressed by the push roller 231 to hereby form a space 'A', where the claw member 232*a* of the print media-releasing member 232 is placed. By means of the claw member 232*a*, the leading end of the print medium 13 passing the contact point P is released from the surface layer 229*b* of the heating roller 229 and continues to advance.

In the above-described embodiment, the surface layer 229*b* of the heating roller 229 is formed of an elastic material, though part of or the entire heating roller 229, in addition to the surface layer 229*b*, may be formed of an elastic material.

In addition, the space A, which is formed by elastic deformation of the surface layer 229*b* in the heating roller 229, may have various shapes, depending upon the size of the push roller 231, the thickness of the surface layer 229*b*, the material forming the surface layer 229*b*, and the like. Therefore, these conditions must be considered when designing the claw member 232*a* of the print media-releasing member 232. In particular, the claw member 232*a*, in most instances, should not to protrude outside of the space A, so that the surface layer 229*b* can be prevented from being damaged due to the claw member 232*a*.

On the other hand, the push roller 231 and the print media-releasing member 232 of this embodiment may be applied to any roller used in the image forming apparatus 200 as long as its surface layer is formed of a resilient material. For example, the push roller 231 and the print media-releasing member 232 can be applied to the conveyor roller 235 (in FIG. 2), which conveys the print medium passed through the fuser 228.

Figure 6:
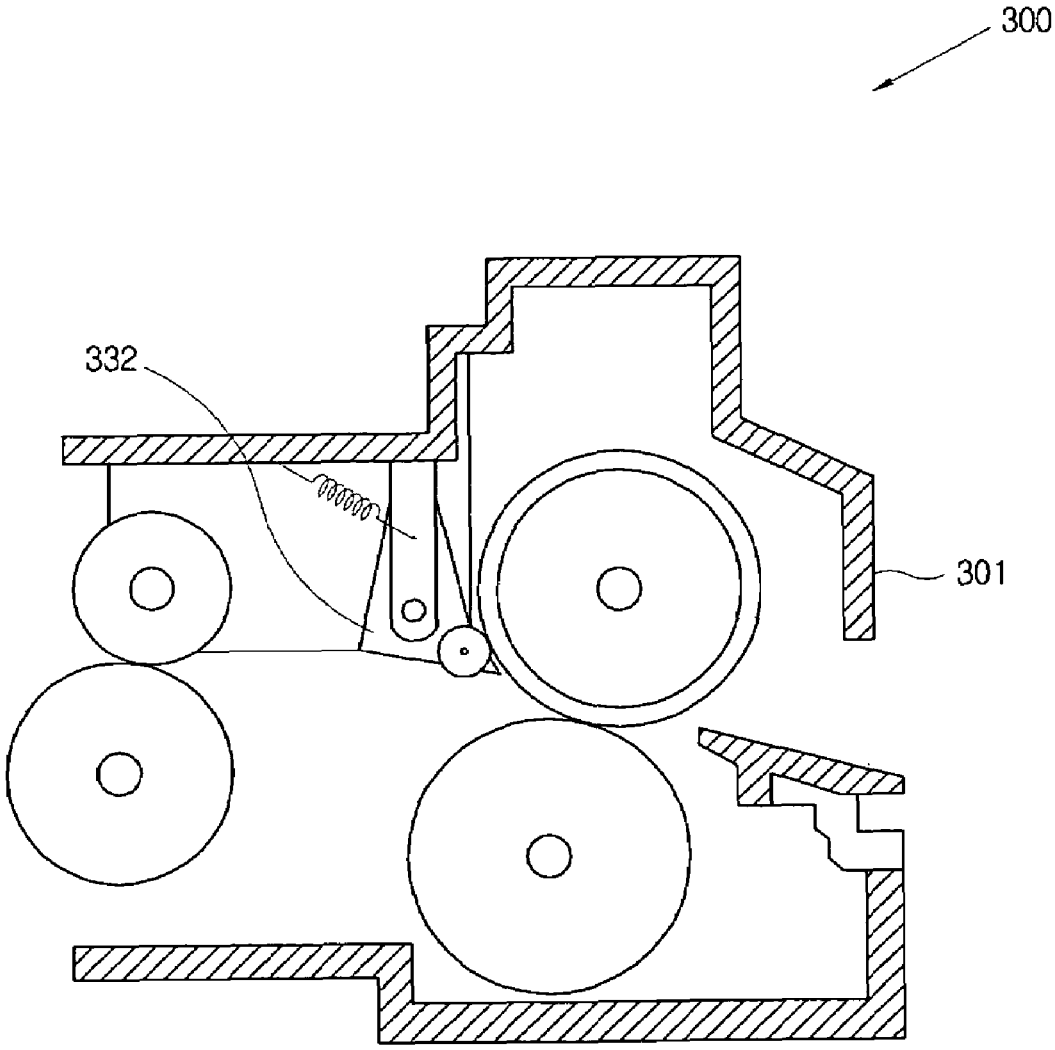
FIG. 6 is a sectional view showing a fuser for an image forming apparatus according to an embodiment of the invention.

In addition, the fuser 228 including the above push roller 231 and the print media-releasing member 232 may be designed so as to be detachably mounted on the image forming apparatus 200. FIG. 6 schematically shows the configuration of a modular fuser 300 according to an embodiment of the present invention. As shown in FIG. 6, a print media-releasing member 332 may be designed to be fixedly supported by a casing 301 of the fuser 300.

As described above, aspects of the present invention provide an image forming apparatus and a fuser therefor, in which a print roller having a resilient surface layer is pressed by a push roller to form a space in-between, and a print medium attached to the print roller can be easily released therefrom by using the space, without damaging the print roller.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus having a print roller, in which a circumferential elastic contact part of the print roller contacts a print medium to convey the print medium, the apparatus comprising:

a push roller pressing the print roller to elastically deform the circumferential elastic contact part creating a space therein; and a print media-releasing member comprising a claw member protruded into the space formed by the push roller on the circumferential elastic contact part, wherein the claw member releases the print medium from the print roller, wherein a rotating axis of the push roller passes through the print media-releasing member.

2. The apparatus as claimed in claim 1, further comprising another push roller, wherein one push roller is provided on a side of the print media-releasing member and the other push roller is provided on an other side of the print media-releasing member.

3. The apparatus as claimed in claim 2, wherein a rotating axis of the other push roller passes through the print media-releasing member.

4. The apparatus as claimed in claim 3, wherein the print media-releasing member is provided with a rotation shaft supporting a rotation of the other push roller.

5. The apparatus as claimed in 3, wherein the other push roller is provided with a rotation shaft passing through the print media-releasing member.

6. The apparatus as claimed in claim 1, wherein the print media-releasing member is provided with a rotation shaft supporting a rotation of the push roller.

7. The apparatus as claimed in claim 1, wherein the push roller is provided with a rotation shaft passing through the print media-releasing member.

8. The apparatus as claimed in claim 1, wherein the print roller comprises a central part, and the circumferential elastic contact part comprises a surface layer formed of an elastic material, the surface layer being formed in the circumferential face of the central part and having a predetermined thickness.

9. The apparatus as claimed in claim 1, wherein the print roller comprises an elastic body.

10. The apparatus as claimed in claim 1, wherein the print media-releasing member is wedge-shaped.

11. The apparatus as claimed in claim 1, wherein the print roller is a heating roller.

12. A fuser for an image forming apparatus including a heating roller having a circumferential elastic contact part and a heater, and a press roller conveying a print medium interposed in-between with the heating roller while contacting the print medium towards the heating roller, the fuser comprising:

a push roller pressing the heating roller to elastically deform the circumferential elastic contact part creating a space therein; and a print media-releasing member comprising a claw member extended into the space formed by the push roller on the circumferential elastic contact part, wherein the claw member releases the print medium from the heating roller, wherein a rotating axis of the push roller passes through the print media-releasing member.

13. The fuser as claimed in claim 12, further comprising another push roller, wherein one push roller is provided on a side of the print media-releasing member and the other push roller is provided on an other side of the print media-releasing member.

14. The fuser as claimed in claim 13, wherein a rotating axis of the other push roller passes through the print media-releasing member.

15. The fuser as claimed in claim 14, wherein the print media-releasing member is provided with a rotation shaft supporting a rotation of the other push roller.

16. The fuser as claimed in claim 14, wherein the other push roller is provided with a rotation shaft passing through the print media-releasing member.

17. The fuser as claimed in claim 12, wherein the print media-releasing member is provided with a rotation shaft supporting a rotation of the push roller.

18. The fuser as claimed in claim 12, wherein the push roller is provided with a rotation shaft passing through the print media-releasing member.

19. The fuser as claimed in claim 12, wherein the heating roller comprises a central part, and the circumferential elastic contact part comprises a surface layer formed of an elastic material, the surface layer being formed in the circumferential face of the central part and having a predetermined thickness.

20. The fuser as claimed in claim 12, wherein the heating roller comprises an elastic body.

21. The fuser as claimed in claim 12, wherein the print media-releasing member is wedge-shaped.

22. An image forming apparatus having a print roller, in which a circumferential elastic contact part of the print roller contacts a print medium to convey the print medium, the apparatus comprising:

a print media-releasing members comprising a claw member, wherein the claw member releases the print medium from the print roller; and a push member pressing the print roller to elastically deform the circumferential elastic contact part creating a space therein, wherein a supporting axis of the push member passes through the print media-releasing member.

23. The apparatus as claimed in claim 22, wherein the print media-releasing member is wedge-shaped.

24. The apparatus as claimed in claim 22, wherein the print roller comprises a central part, and the circumferential elastic contact part comprises a surface layer formed of an elastic material, the surface layer being formed in the circumferential face of the central part and having a predetermined thickness.

25. The apparatus as claimed in claim 22, wherein the print roller comprises an elastic body.

26. The apparatus as claimed in claim 22, wherein the push member comprises a non-corrosive upper surface pressing the print roller to elastically deform the circumferential elastic contact part creating the space therein.

27. The apparatus as claimed in claim 22, wherein the claw member is protruded into the space formed by the push member on the circumferential elastic contact part.

28. The apparatus as claimed in claim 22, wherein the push member is a push roller.

29. The apparatus as claimed in claim 28, wherein the claw member is protruded into the space formed by the push roller on the circumferential elastic contact part.

30. The apparatus as claimed in claim 28, further comprising another push roller, wherein one push roller is provided on a side of the print media-releasing member and the other push roller is provided on an other side of the print media-releasing member.

31. The apparatus as claimed in claim 30, wherein a rotating axis of the push roller passes through the print media-releasing member.

32. The apparatus as claimed in claim 31, wherein the print media-releasing member is provided with a rotation shaft supporting a rotation of the push roller.

33. The apparatus as claimed in 31, wherein the push roller is provided with a rotation shaft passing through the print media-releasing member.

34. The apparatus as claimed in claim 28, wherein a rotating axis of the push roller passes through the print media-releasing member.

35. The apparatus as claimed in claim 34, wherein the print media-releasing member is provided with a rotation shaft supporting a rotation of the push roller.

36. The apparatus as claimed in claim 34, wherein the push roller is provided with a rotation shaft passing through the print media-releasing member.

37. The apparatus as claimed in claim 22, wherein the print roller is a heating roller.

38. An image forming apparatus having a print roller, in which a circumferential elastic contact part of the print roller contacts a print medium to convey the print medium, the apparatus comprising:

a push roller comprising a non-corrosive upper surface pressing the print roller to elastically deform the circumferential elastic contact part creating a space therein; and a print media-releasing member comprising a claw member protruded into the space formed by the push member on the circumferential elastic contact part, wherein a rotating axis of the push roller passes through the print media-releasing member.

39. The apparatus as claimed in claim 38, wherein the push roller rotates with the print roller.

40. The apparatus as claimed in claim 38, wherein the print roller comprises a central part, and the circumferential elastic contact part comprises a surface layer formed of an elastic material, the surface layer being formed in the circumferential face of the central part and having a predetermined thickness.

41. The apparatus as claimed in claim 38, wherein the print roller comprises an elastic body.

42. The apparatus as claimed in claim 38, wherein the print media-releasing member is wedge-shaped.

43. The apparatus as claimed in claim 38, wherein the print roller is a heating roller.

44. A method of separating a print medium from a print roller, the method comprising:

elastically deforming, by a push roller, a circumferential elastic contact part of the print roller creating a space therein;

releasing the print medium from the print roller by catching the print medium with a claw member of a print medium-releasing member protruding into the space, wherein a rotating axis of the push roller passes through the print media-releasing member.

* * * * *

UNITED STATES PATENT AND TRADEMARK OFFICE

CERTIFICATE OF CORRECTION

PATENT NO. : 7,715,772 B2
APPLICATION NO. : 11/439966
DATED : May 11, 2010
INVENTOR(S) : Young-soo Ko It is certified that error appears in the above-identified patent and that said Letters Patent is hereby corrected as shown below:

Column 6, Line 14, change "in 3," to --in claim 3,--

Signed and Sealed this

Seventeenth Day of August, 2010

David J. Kappos

David J. Kappos
*Director of the United States Patent and Trademark Office*